United States Patent [19]

Sinkkonen

[11] Patent Number: 4,854,772

[45] Date of Patent: Aug. 8, 1989

[54] METHOD TO MANUFACTURE COMPACTOR AND COMPACTOR MANUFACTURED BY THE METHOD, AND COMPACTOR SERIES

[75] Inventor: Matti Sinkkonen, Vaajakoski, Finland

[73] Assignee: Tana Jyra Ky, Finland

[21] Appl. No.: 847,180

[22] PCT Filed: Jun. 28, 1985

[86] PCT No.: PCT/FI85/00060

§ 371 Date: Mar. 19, 1986

§ 102(e) Date: Mar. 19, 1986

[87] PCT Pub. No.: WO86/00654

PCT Pub. Date: Jan. 30, 1986

[30] Foreign Application Priority Data

Jul. 4, 1984 [FI] Finland ..... 842678

[51] Int. Cl.[4] ..... E02D 3/026

[52] U.S. Cl. ..... 404/121; 404/124; 404/128; 404/72; 296/187

[58] Field of Search ..... 404/83, 121, 122, 124, 404/128, 72; 180/89.1, 20, 209, 311, 12; 280/785; 172/114, 116, 125; 296/197, 186, 187

[56] References Cited

U.S. PATENT DOCUMENTS

| | | | |
|---|---|---|---|
| 1,345,498 | 7/1920 | McCartney | 180/209 |
| 2,226,182 | 12/1940 | Ross | 404/121 |
| 2,437,524 | 3/1948 | Harrison et al. | 404/121 X |
| 3,280,931 | 10/1966 | Cahill et al. | 180/12 X |
| 3,486,427 | 12/1969 | Waschulewski et al. | 404/117 |
| 3,868,194 | 2/1975 | Ferguson et al. | 404/126 |
| 4,260,280 | 4/1981 | Hirn et al. | 180/20 X |
| 4,281,945 | 8/1981 | Sinkkonen | 404/121 |
| 4,422,685 | 12/1983 | Bonfilio et al. | 296/197 |
| 4,530,620 | 7/1985 | McCartney | 404/121 |
| 4,676,545 | 6/1987 | Bonfilio et al. | 296/197 |

FOREIGN PATENT DOCUMENTS

| | | | |
|---|---|---|---|
| 147713 | 9/1979 | Denmark . | |
| 0067243 | 12/1982 | European Pat. Off. . | |
| 1142622 | 1/1963 | Fed. Rep. of Germany | 404/122 |
| 1945227 | 3/1971 | Fed. Rep. of Germany . | |
| 2439788 | 3/1976 | Fed. Rep. of Germany . | |
| 2058718 | 11/1979 | Fed. Rep. of Germany . | |
| 3032234 | 8/1980 | Fed. Rep. of Germany . | |

*Primary Examiner*—Jerome W. Massie, IV
*Assistant Examiner*—Matthew Smith
*Attorney, Agent, or Firm*—Lahive & Cockfield

[57] ABSTRACT

A method for manufacturing such compactors in different sizes that are meant to be used e.g. on dumping sites for crushing refuse and for compacting the refuse layer. The main parts of the compactors are chassis, engine and cylinder-shaped drums. As per the method according to the invention the compactors are essentially assembled of interchangeable components and modules, of which a varying number is used in assembling compactors of different sizes. The invention also relates to manufacturing a compactor of a compactor series by means of the method. According to the invention the compactor series is mainly assembled by selecting interchangeable drum unit components from three different widths and by using 1, 2, 3 or 4 power transmission gear assemblies, according to the size of the compactor, attached to the ends of the drum unit or units.

16 Claims, 11 Drawing Sheets

METHOD TO MANUFACTURE COMPACTOR AND COMPACTOR MANUFACTURED BY THE METHOD, AND COMPACTOR SERIES

The Invention relates to a Method to manufacture such compactors in different sizes that are meant to be used e.g. on dumping sites for crushing refuse and for compacting the base i.e. the refuse layer, or e.g. coal fields for levelling coal stacks and for compacting the surface layer, or for some other kind of compacting tasks, the main parts of such compactors being chassis, engine and drum, the preferable number of which is two, and power transmission assembly to transmit the rotary motion to one or more drums, and according to which manufacturing method the compactors are mainly assembled of the afore mentioned and of other prefabricated parts i.e. modules.

It a well-known fact that in the maintenance of e.g. dumping sites the most preferable method is to use specially made compactors equipped with spiked wheels to crush and compact the refuse as efficiently as possible. By using these special compactors several other advantages are reached compared with results achieved through other equipment. Firstly, the dumping site is used optimally: as the refuse is compacted into a smaller space, the dumping site does not need to be extended unnecessarily. Further, by compacting the refuse the living conditions of a vermin and noxious animals are eliminated, the danger of fire is reduced essentially and the need for covering material is reduced. The utility life of the dumping site is extended and the moving of the vehicles bringing the refuse is facilitated owing to the even, well-compacted surface of the dumping site.

Practice has shown that dumping sites are of different sizes and require compactors of various sizes. This is because the dumping sites of large cities have to be able to take thousands of tons of refuse every day, whereas smaller towns only produce some tens of tons of refuse, one hundred tons at the most. When communities started to build controlled dumping sites, in some countries, such as Finland, several communities jointly built a dumping site for common use. In this way the dumping sites could be made sufficiently large to enable the use of special equipment. As even in these cases the preferable distance between dumping sites is less than 50 km, smaller sites develop next to the big sites, especially in big cities.

The smaller dumping sites traditionally use appro. 100 h.p. compactors, which can handle about 20–60 tons of refuse per hour. Large dumping sites use 400 or more h.p. compactors, whose capacity is more than 200 tons per hour. As the sizes and capacities of compactors vary so greatly, they are built to suit the purpose, i.e. almost each part of the compactor is dimensioned in a different way depending on the size of the compactor.

The purpose of this Invention is to produce a new, more efficient and favourable method of manufacturing compactors, a new type of compactor manufactured using this method and a compactor series based on the method.

A suitable surface pressure of the drums for rolling and compacting has been chosen as the dimensioning unit for the new compactor. As the feet or spikes attached to the surface of the drum make it difficult to determine the surface pressure and as a cylinder-shaped drum has only a narrow touch with an even surface, the surface pressure has, for the sake of simplicity, been replaced by the ratio of the weight of the compactor to the unit of width of the drum. With a compactor, this dimensioning basis can be reached by dividing the weight of the compactor by the combined width of both the drums. Therefore, to make the weight of each compactor of the compactor series per the unit of width of the drums the same, the total rolling width of the lightest compactor is the narrowest and the total rolling width of the heaviest compactor is the wildest. In practice the optimum weight of the compactor per unit of width, calculated in the above way, is 4–5 tons. Practice has also shown that the power requirement of a compactor is about 10 hp/ton, which means that a compactor weighing 10 tons requires an engine of about 100 h.p. and correspondingly a compactor weighing 40 tons requires an engine of 400 h.p. One object of this Invention is to manufacture a compactor within this efficiency range in a new way and at a lower cost than before. At the same time all the compactors of the series could be dimensioned in the right way so as to make the ratio of the engine output and the weight of the compactor and the ratio between the weight and the combined width of the rollers to follow the above mentioned dimensioning principles.

The above aims are reached in a new way by means of the the method of the Invention. The characteristics of the manufacturing method are to be found in the attached Patent claims Nos. 1–5 and the characteristics of the compactor manufactured in accordance with the aforementioned method are to be found in Patent claims Nos. 6–16.

The Invention combines the advantages of the general principles of module structures, e.g. the ready availability of service and spare parts, to reach optimum dimensioning for all the compactors in the series.

The Invention is illustrated in the following by means of examples, by referring to the attached drawings, in which FIG. 1 shows a side view of the drum unit component of a compactor according to the Invention.

Figure 13:
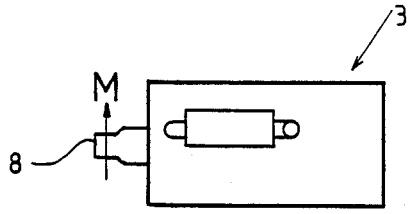
FIG. 13 shows a diagrammatic side view of the engine of the compactor and the hydraulic pump module connected thereto.
Figure 14:
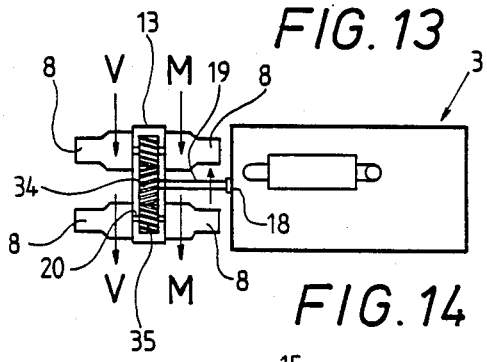

FIG. 14 corresponds to FIG. 13 and shows an engine with four hydraulic pumps connected thereto.

Figure 15:
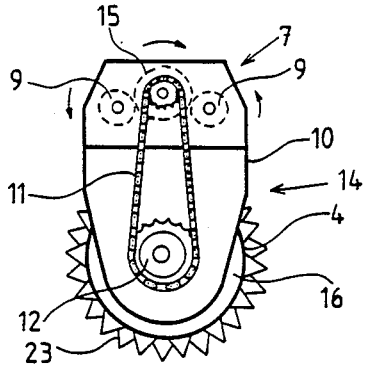

FIG. 15 shows a diagrammatic side view of the transmission assembly between the gear assembly module and the drum unit component.

Figure 16:
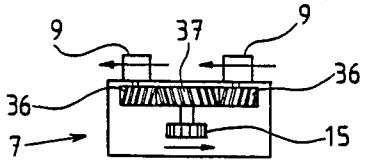

FIG. 16 shows a top plan view of the gear assembly module of FIG. 15.

Figure 17:
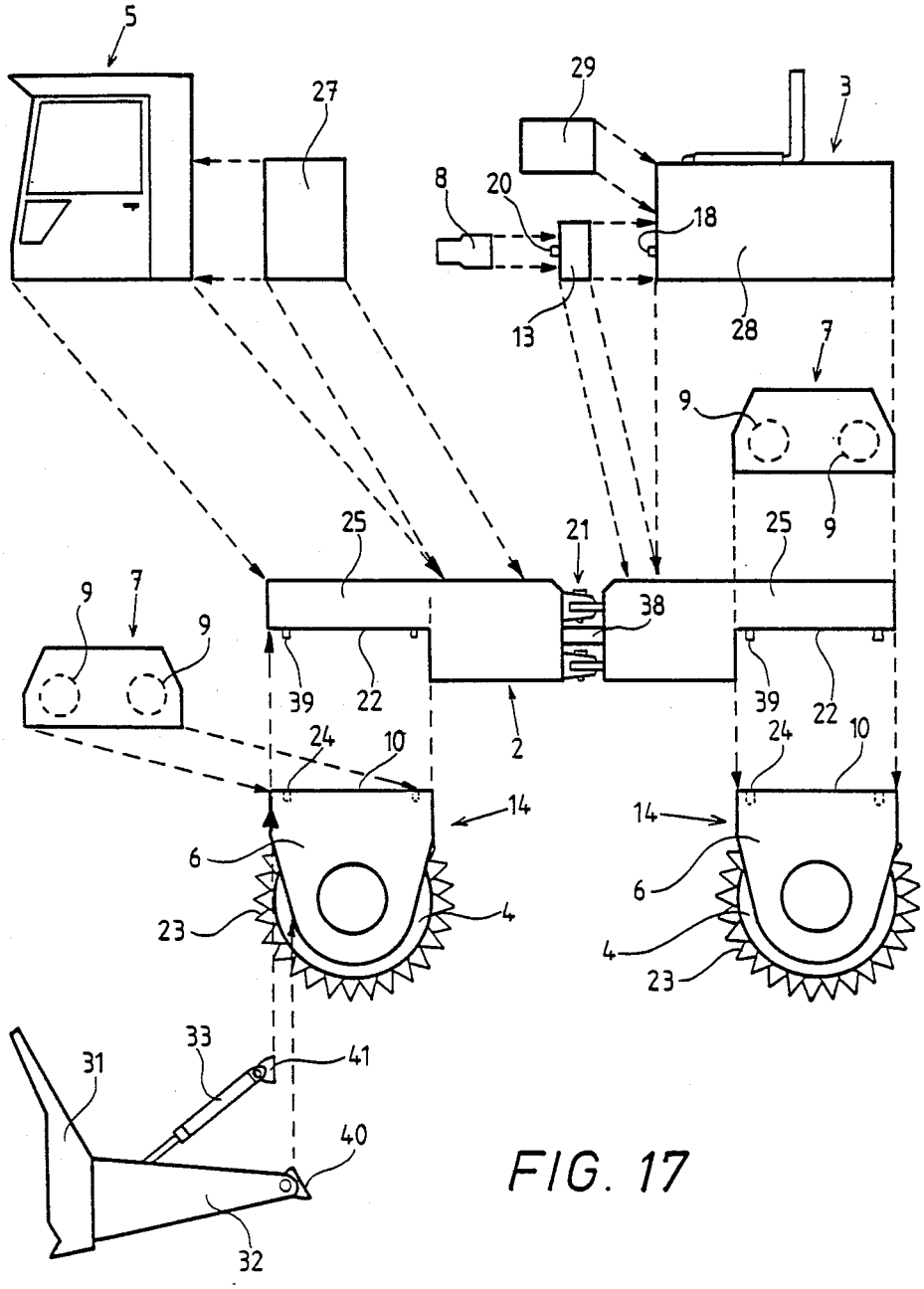

FIG. 17 shows a diagrammatic side view of the assembly system of the main components of a compactor according to the Invention.

Figure 18:
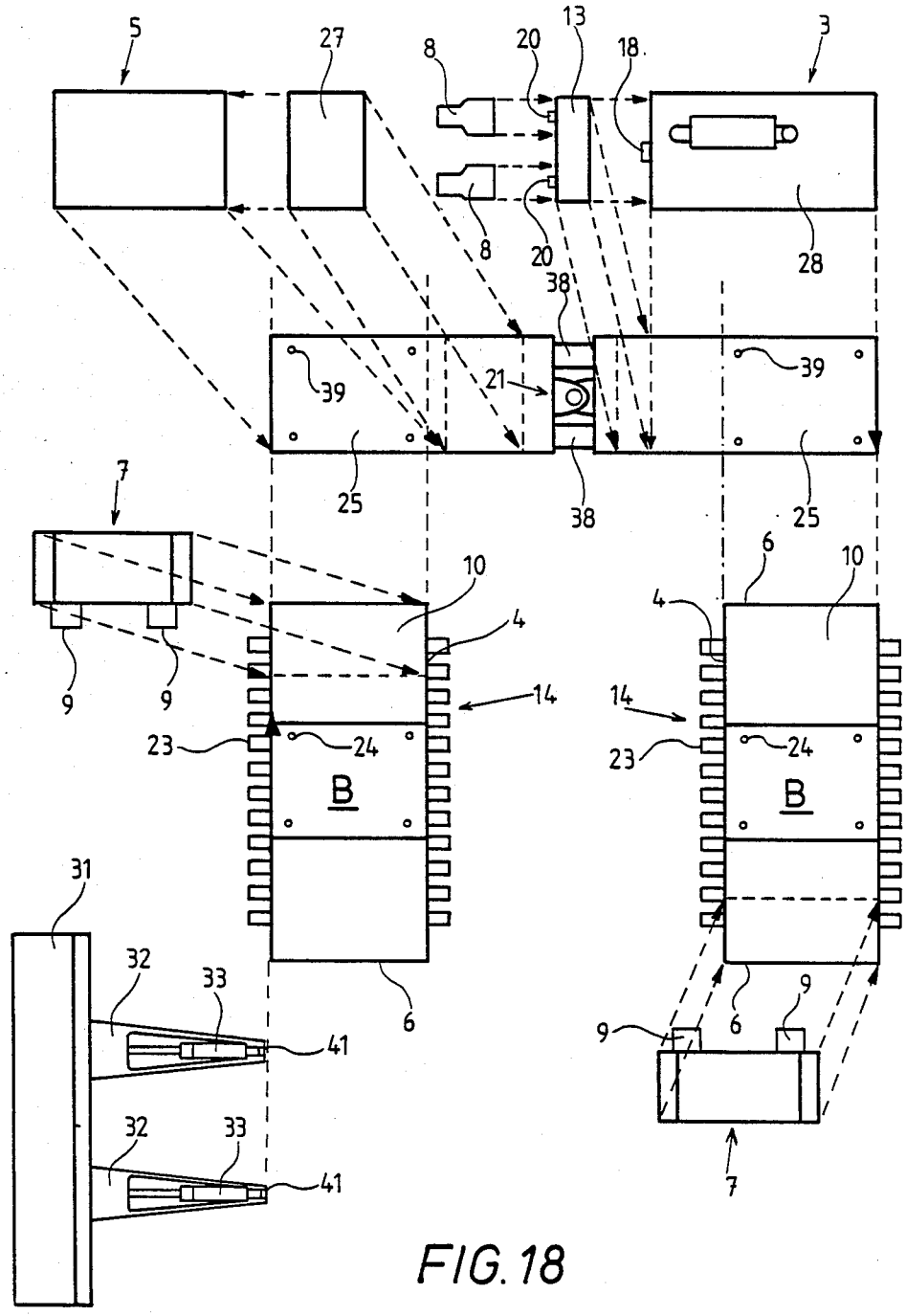

FIG. 18 shows a diagrammatic top plan view of the assembly system of FIG. 17.

FIGS. 19–22 show a diagrammatic top plan view of the assembly system of a series of four compactors according to the Invention.

Figure 23:
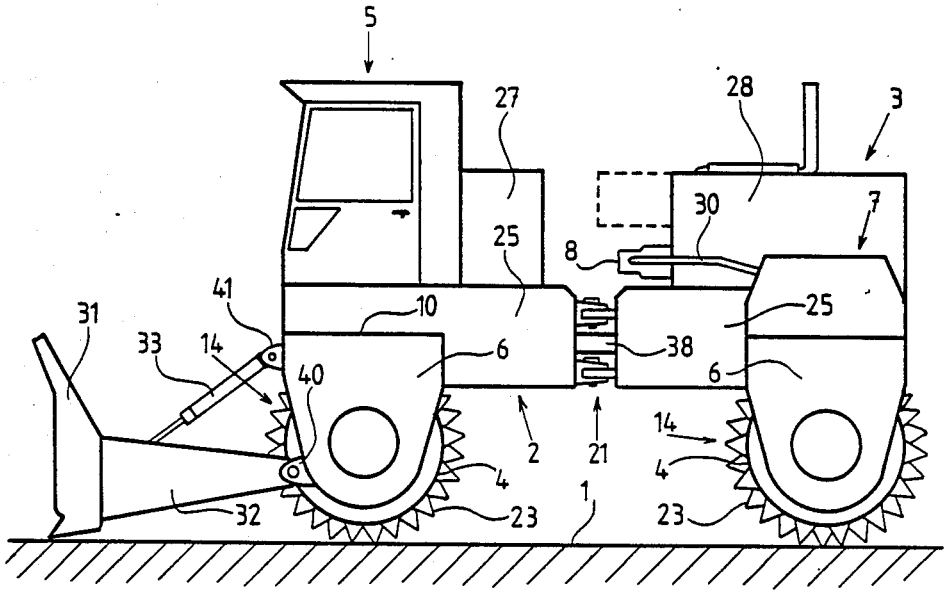

FIG. 23 shows a side view of an embodiment of the compactor according to the Invention.

Figure 24:
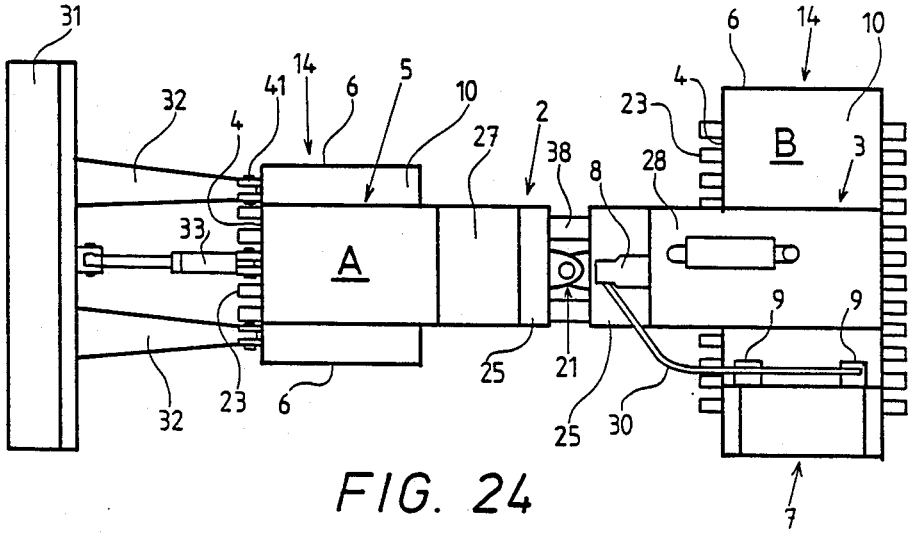

FIG. 24 shows a top plan view of the compactor of FIG. 23.

Figure 25:
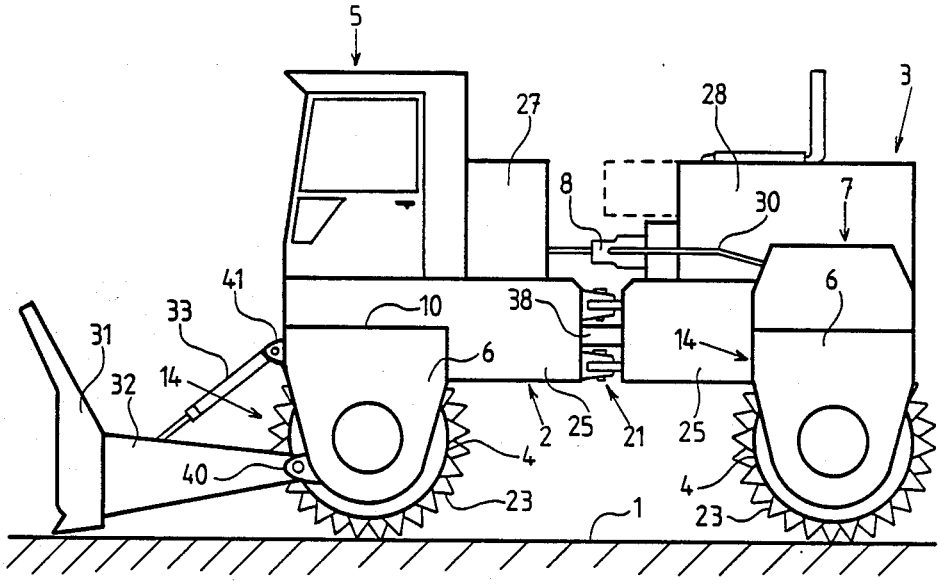

FIG. 25 corresponds to FIG. 23 and shows another embodiment of the compactor.

Figure 26:
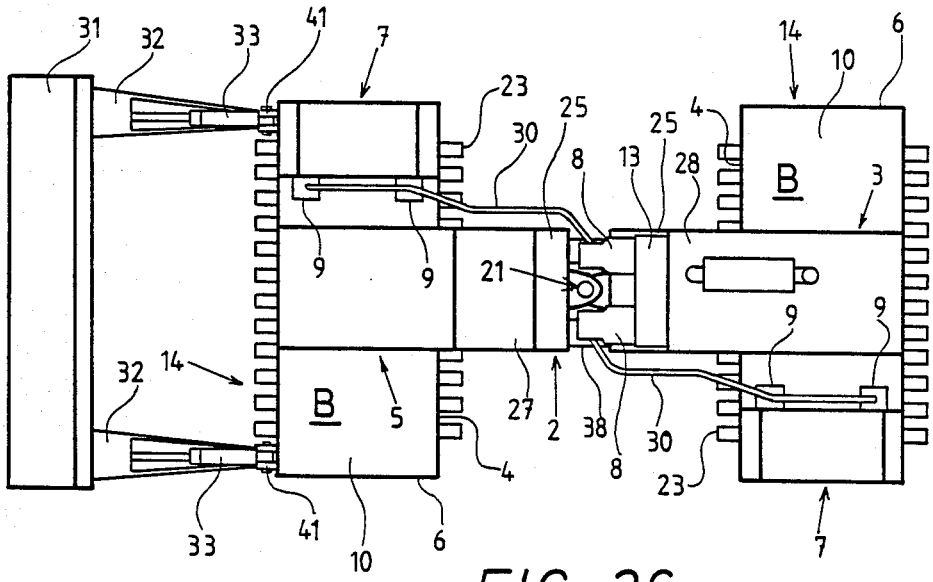

FIG. 26 shows a top plan view of the compactor of FIG. 25.

Figure 27:
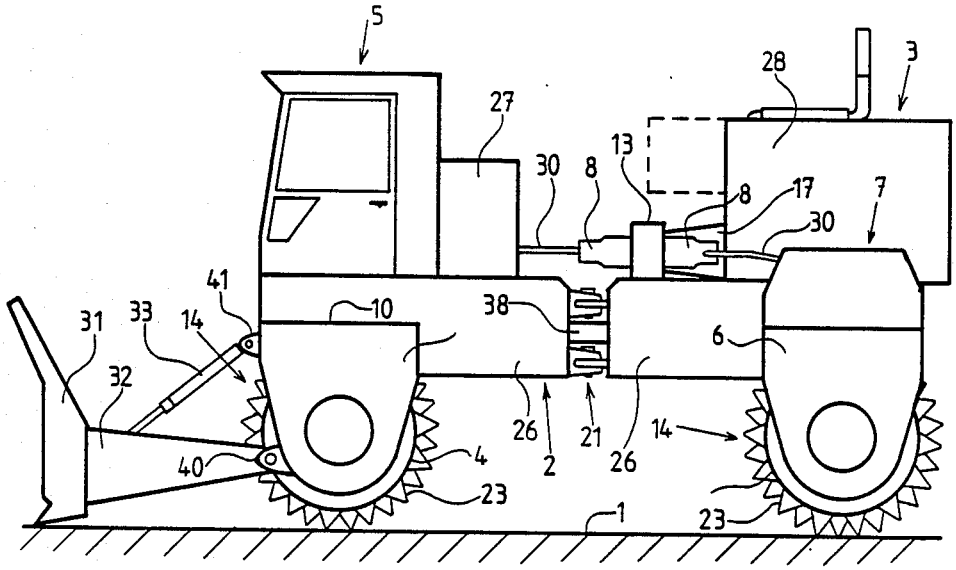

FIG. 27 correspond to FIG. 23 and shows a third embodiment of the compactor.

Figure 28:
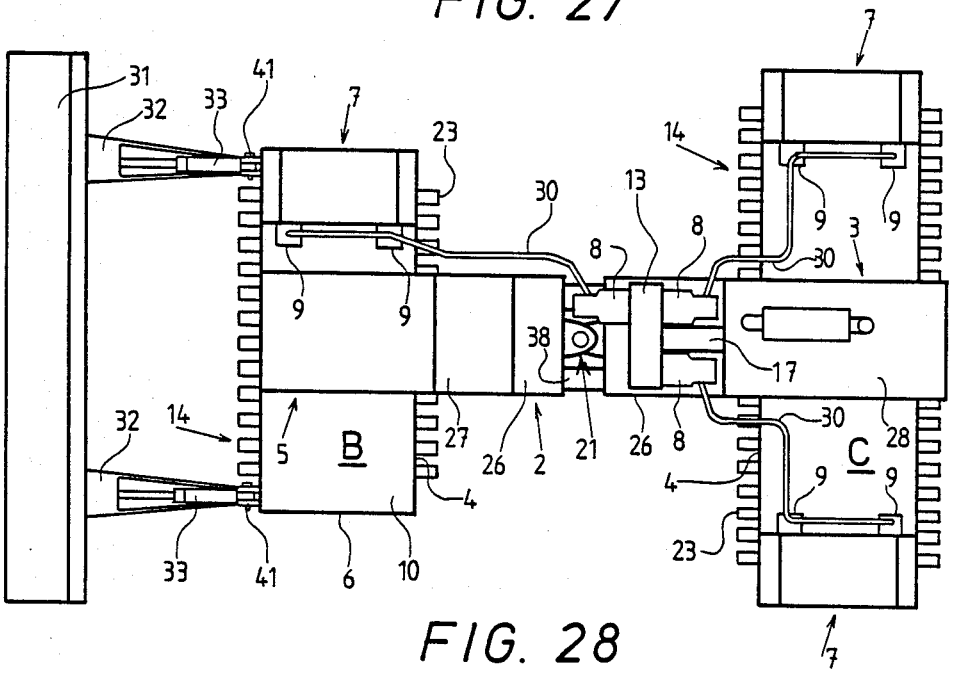

FIG. 28 shows a top plan view of the compactor of FIG. 27.

Figure 29:
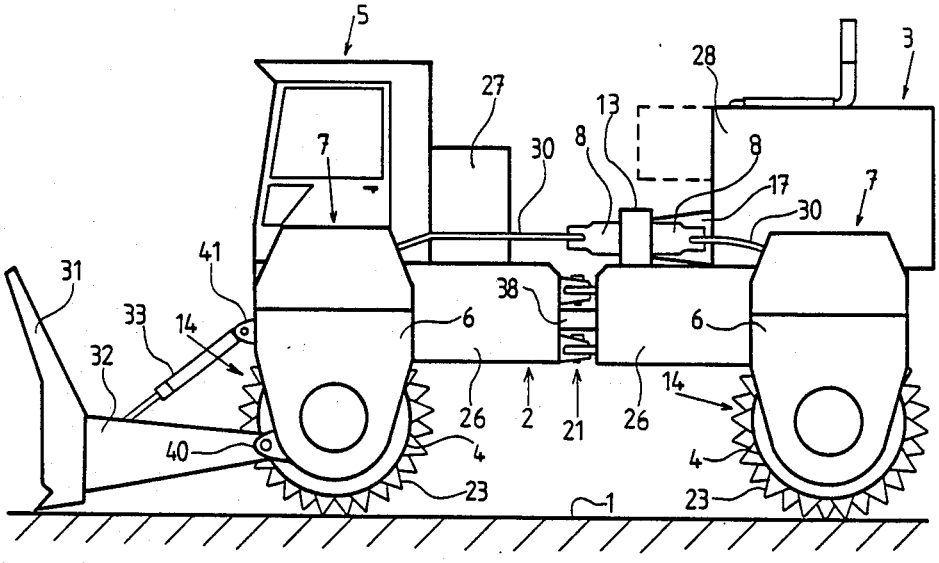

FIG. 29 corresponds to FIG. 23 and shows a fourth embodiment of the compactor.

Figure 30:
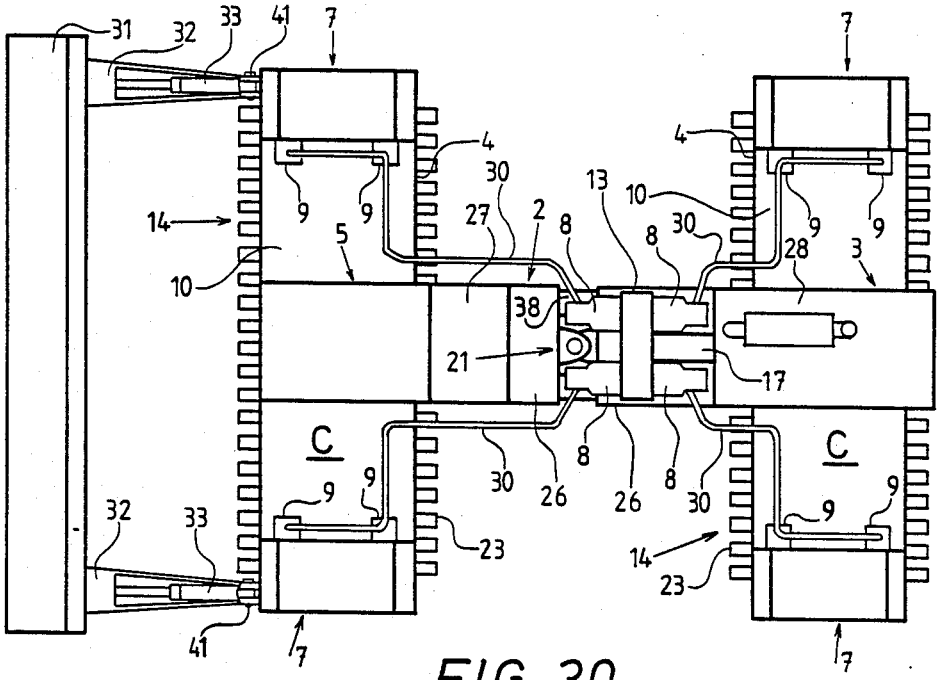

FIG. 30 shows a top plan view of the compactor of FIG. 29.

Figure 31:
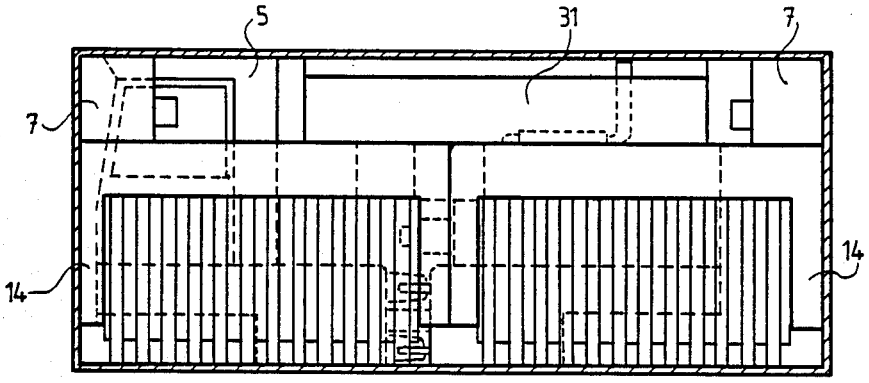

FIG. 31 is a diagrammatic side view of a compactor according to the Invention, packed in a container, one side wall of which has been removed.

Figure 32:
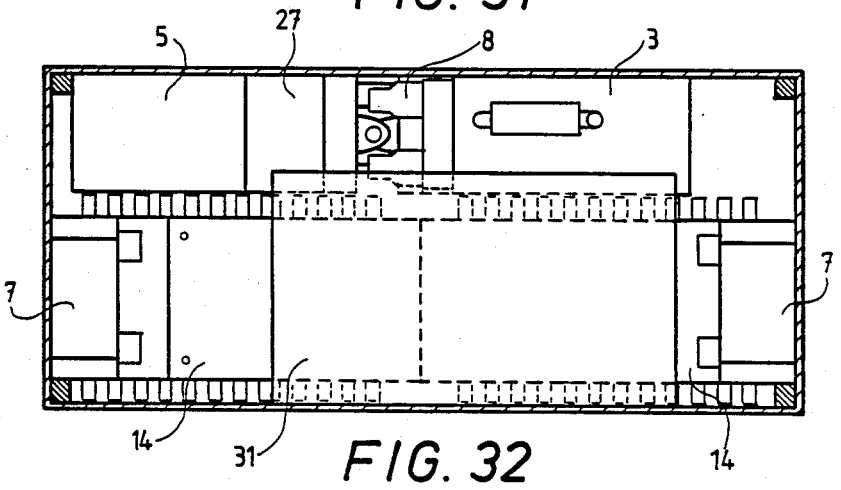

FIG. 32 shows a top plan view of the container of FIG. 31 with the top removed.

Figure 33:
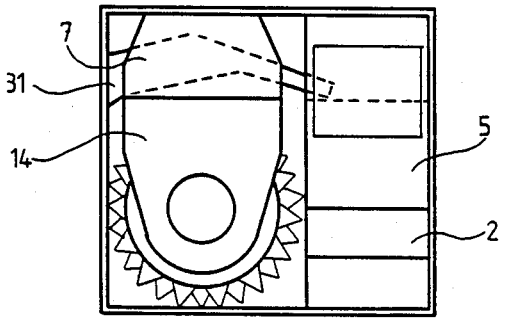

FIG. 33 shows the container of FIG. 31 seen from the right and with the end wall removed.

Figure 1:
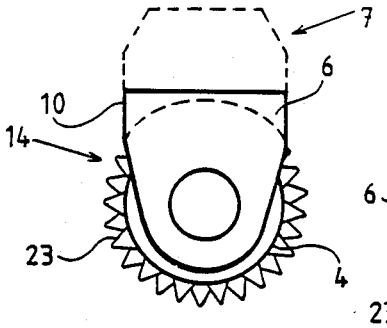
Figure 2:
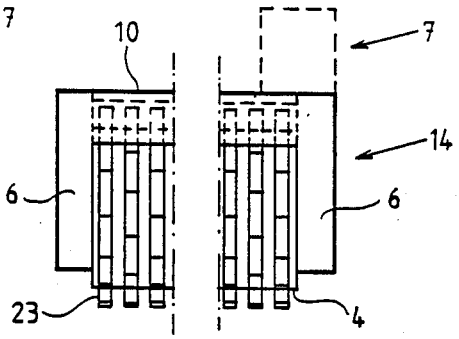
FIG. 2 shows a frontal view of the drum unit component of FIG. 1.

FIGS. 1 and 2 show a drum component 14 according to the Invention, consisting of a horizontal drum frame 10, to the ends of which vertical end pieces 6 are attached, as well as a drum 4, which is provided with spikes 23, mounted on it with bearings. It is possible to connect a gear assembly module 7 above the end pieces 6, which module rotates the drum 4 (at the ends) through e.g. a chain and sprocket. FIG. 2 shows the gear assembly module 7 drawn with dotted lines at one end of the drum unit 14, but the gear assemblies can be mounted on both ends, in which case the drum 4 is rotated at both ends.

Figure 3:
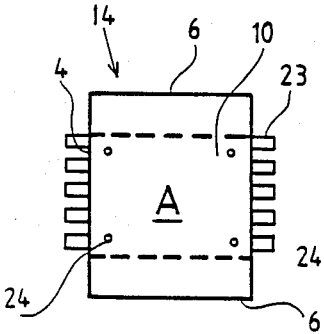
FIGS. 3–5 show a top plan view of drum unit components of three different widths.
Figure 4:
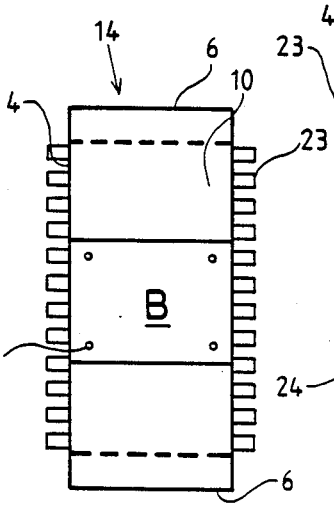
Figure 5:
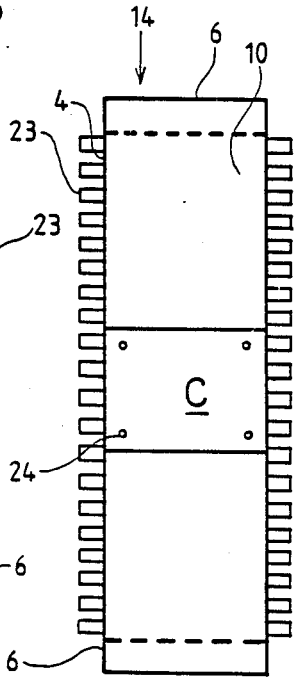

FIGS. 3–5 show a top plan view of three drum units 14 of different widths. The figure shows that the drum units 14 are of different widths, and therefore the drums 4 belonging to them are also of different widths. The diameter of all the drums is the same and the spike rows 23 on the drums 4 are also similar in all the drums. The widest drum naturally has more spike rows than a narrower drum.

FIGS. 3, 4 and 5 show three drum units which are dimensioned, according to the Invention, in such a way that, by using such components, a compactor series of four compactors of different sizes can be assembled. The drum unit size shown in FIG. 3 has been marked with the letter A. Its drum width is 0.9 m and the number of spike rows is five. The width of the drum in drum unit B shown by FIG. 4 is 2.3 m and the number of spike rows is 12. In FIG. 5, the width of the drum in drum unit C is 3.7 m and the number of spike rows is 20. The diameter of all these drums is 1.2 m. Attaching points 24 are placed in the centre part of the drum frame 10 in each drum unit A, B and C, and thus the drum units form interchangeable components. Thus any drum unit component can be attached to the chassis of the compactor at these attaching points, with e.g. bolts. The assembly system as to choosing the drum units is described in more detail in FIGS. 19–22.

Figure 6:
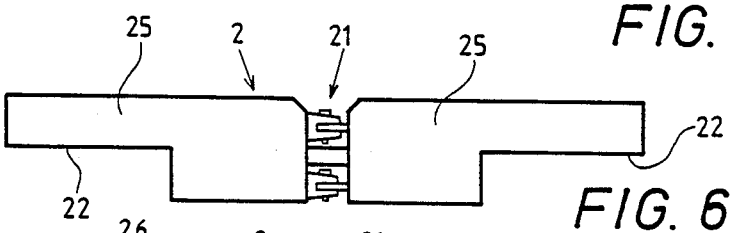
FIGS. 6–7 show a side view of chassis components of two different lengths.
Figure 7:
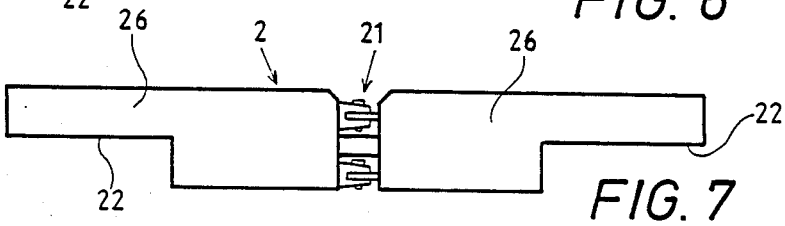

FIGS. 6 and 7 show a side view of two of the chassis components 2 of the compactor. Both consist of two similar chassis elements 25 or 26, which are connected to each other with hinges 21. The chassis elements are equipped with attaching points 22 for the drum units 14 in such a way that any of the interchangeable drum units A, B or C can be attached to them.

The difference in the chassis components 2 of FIGS. 6 and 7 is in their length. The chassis element 26 of FIG. 7 is, in this example, so much longer than the chassis 25 of FIG. 6 that when using the latter elements in the chassis component the wheel base of the compactor is 0.4 m longer. In other respects the chassis components are identical. The longer chassis component shown in FIG. 7 is used in the larger compactors of the compactor series according to the Invention and respectively the chassis component shown in FIG. 6 is used in the smallest compactors. The choice of the chassis components in connection with the assembly system of the compactor is explained in more detail in FIGS. 19–22.

FIGS. 8–12 show components related to the manufacturing method according to the Invention, most of which components are suitable for the whole compactor series: interchangeable components for compactors of various sizes, or modules used in assembly.

Figure 8:
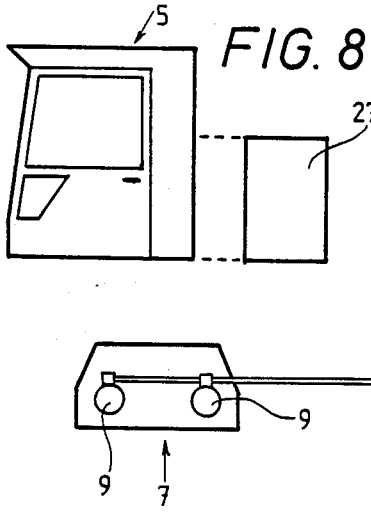
FIG. 8 shows a side view of the cab component and the fuel tank attached threon.

FIG. 8 shows a side view of the cab component 5 of the compactor, which cab can be attached as such to all the compactors of various sizes in the compactor series. A fuel tank 27, which is identical in all the compactors, is behind the cab. The fuel tank can be dimensioned so that it contains sufficient amount of fuel for one work shift for the largest compactor. For the smaller compactors the amount of fuel would be sufficient for a longer period, making the tank unnecessarily large. On the other hand, there is no harm in a large fuel tank, as the increase in the weight is insignificant.

Figure 9:
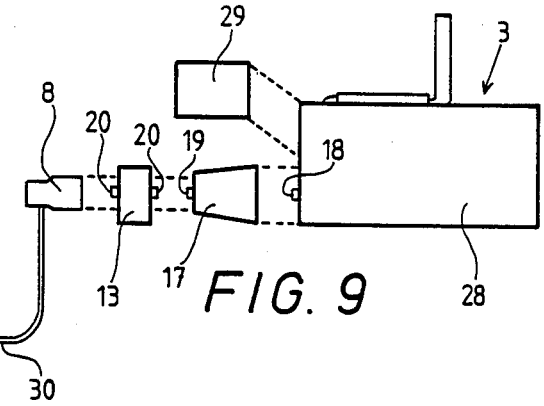
FIG. 9 shows a diagrammatic side view of the power transmission assembly between the engine and the gear assembly, rotating the drum unit.

FIG. 9 shows a side view of a part of the power transmission assembly of the compactor. The engine 3 is placed in a protective casing 28, which can be identical in the whole compactor series. In practice, however, there are two different sizes, with the smaller being used in the two smallest compactors of the exemplary series and the larger in the two largest compactors of the series. A similar solution is used for the hydraulic oil tank 29 attached to the protecting casing 28 of the engine. For practical reasons two sizes are used, although one size would be sufficient.

The power transmission assembly of FIG. 9 consists of a hydrostatic hydraulic pump module 8 rotated by the engine 3. From the hydraulic pump 8 the pressurized hydraulic fluid is lead through a hydraulic hose 30 to hydraulic motors 9 rotating a gear assembly module 7. Between the hydraulic motor 9 and the pump 8 there is a return hose for the hydraulic fluid. This is not, however, shown in the attached drawings. The hydraulic pump 8, the hydraulic motor 9 and the gear assembly 7 togetheru form a power transmission module, through which the rotary motion of the engine 3 is transmitted to one end of the driving drum. The power transmission module also includes a chain power transmission module with a chain and sprocket, placed between the gear assembly 7 and the drum. This is shown in more detail in FIG. 15.

Power transmission from the engine to a driving drum or drums can, by means of the aforementioned power transmission moduls, also be arranged at each end of the drum or on one end of both the drums. In this case each power transmission module requires a hydraulic pump 8 driven by the engine.

In the examplary compactor series described later, the compactors of various sizes have either one, two, three or four hydraulic pump modules and a corresponding number of power transmission modules. The hydraulic pump 8 can be connected to the engine 3 direct, if only one pump module is used, but if several pumps are connected, a pump drive 13 can be installed at a distance from the engine 3 by means of a connecting piece 17. In this case the intermediate shaft 19 of the connecting piece 17 is attached to the power output shaft of the engine 3. The intermediate shaft, on the other hand, rotates the pump drive 13. Through this arrangement hydraulic pumps 8 can be connected to both ends of the power output shafts 20 of the pump drive 13.

Figure 10:
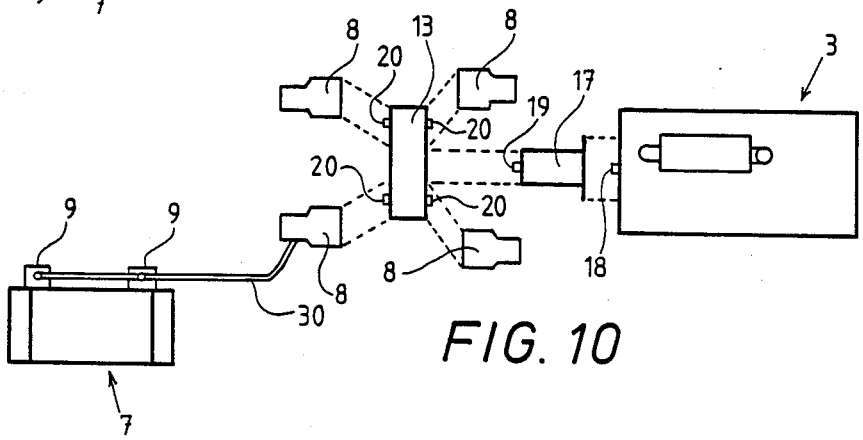
FIG. 10 shows a top plan view of the transmission assembly of FIG. 9.

FIG. 10 shows a diagrammatic top plan view of the power transmission assembly of FIG. 9. When the pump drive 13 is connected with the engine 3 through the connecting piece 17 and the intermediate shaft 19 mounted with bearings thereon, sufficient space is left round the pump drive for four hydraulic pump modules 8 to be connected to it. In other words a hydraulic pump 8 can be connected to each end of each power output shaft 20 of the pump drive, if necessary. Four pumps and four power transmission modules connected with them are used in the largest compactor of the exemplary series. FIG. 10 shows all the four possible pump modules 8, but for the sake of simplicity only one of them has the hydraulic pipe 30, hydraulic engines 9 and pump drive module 7 drawn in the figure.

Figure 11:
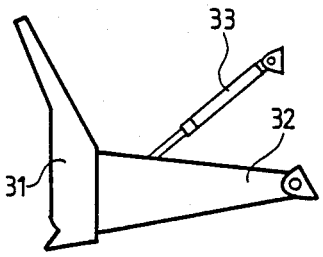
FIG. 11 shows a side view of the dozer blade and the attaching elements threof.
Figure 12:
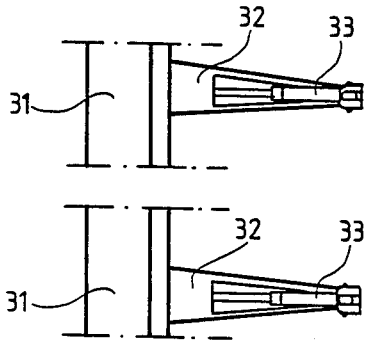
FIG. 12 shows a top plan view of the attaching elements of the dozer blade of FIG. 11.

FIGS. 11 and 12 show the dozer blade 31 of the compactor. The blade is attached to the front drum unit of the compactor with two arms 32 and with one or two hydraulic cylinders 33. The width and the construction of the dozer blade 31 varies in accordance with the width of the drum unit. In other respects the dozer blade can be made similar for all the various compactor sizes of the compactor series.

FIGS. 13 and 14 show a diagrammatic top plan view of the power transmission assembly between the hydraulic pump modules 8 and the engine 3. In the embodiment of the figure there is only one hydraulic pump 8. In this case the pump is connected direct to the engine 3, and therefore the pump 8 rotates in the same direction as the power output shaft of the engine 3. The rotary motion that is in the same directing as that of the engine is marked with the letter M.

In FIG. 14 four hydraulic pump modules 8 have been connected to the engine 3 through a pump drive 13. The pump drive 13 is installed at a distance from the engine by means of an intermediate shaft 19, to give space for two hydraulic pumps 8 between the pump drive 13 and the engine 3. In the power transmission assembly of FIG. 14 the centre cog-wheel 34 of the pump drive is rotated by the power transmission shaft 19 of the engine 3 through an intermediate shaft 19. The centre cog-wheel 34 rotates secondary cog-wheels 35 and the power output shafts 20 of the pump drive attached thereto. Hydraulic pumps 8 are attached to both ends of each of these shafts 20. The direction of rotation for the intermediate shaft 19 and the centre cog-wheel 14 of the pump drive is the same as that of the power output shaft of the engine 3, i.e. the direction of rotation of the engine, whereas the direction of rotation of the secondary cog-wheel 35 of the pump drive 13 and the shafts 20 attached thereto is the opposite. The direction of rotation of the hydraulic pumps 8 connected to the ends of the power output shafts 20 is determined by the side of the pump drive that they are placed on. In FIG. 14 the hydraulic pumps 8 placed between the pump drive 13 and the engine 3 rotate in the same direction as the engine 3, and the hydraulic pumps placed on the opposite side of the pump drive rotate in the opposite direction. The rotary motion that takes place in the same direction as that of the engine is marked with the letter M in the figure, and the rotary motion in the opposite direction with the letter V. The figure shows that different assemblies require hydraulic pumps with different directions of rotation.

FIG. 15 shows a side view of the power transmission assembly placed at the end of the drum unit 14, which assembly consists of a gear assembly module 7 driven by two hydraulic motors placed on the drum frame 10. The gear assembly 7 rotates the drum 14 at one end through a power transmission module consisting of a chain 11 and sprockets 15 and 12. According to the Invention the gear assembly 7 is made into such a module as can be connected as such to the end of any drum unit 14. Correspondingly, the power transmission of the end piece of the drum frame 10 forms a chain power transmission module that can be placed as such in any of the compactors of the compactor series.

FIG. 16 shows a diagrammatic side view of the gear assembly module. In the assembly including hydraulic motors 9 rotate one common secondary cog-wheel 37 through cog-wheels 36. The secondary cog-wheel has been placed on the same shaft as the sprocket 15. This sprocket rotates the sprocket 12, which is attachedto the drum 4, through a chain. FIG. 16 shows the gear assembly 7 in a simplified form, as the rotary speed of the hydraulic motor 9 is normally so fast that several successive sprockets have to be used in the gear assembly to reduce the rotary speed to make it suitable for the drum FIG. 17 shows a diagrammatic side view of the assembly of the main parts of one embodiment of the compactor according to the Invention. The chassis 2 of the compactor is formed by identical chassis elements 25, which are connected to each other with hinges 21. The compactor is steered by turning the chassis elements in relation to each other by means of hydraulic stearing cylinders 38. Interchangeable drum units 14 of required size are attached to the chassis 2 at attaching points 22 that are underneath the chasses 2 as per the assembly system described later. The attaching points 22 of all the drum units 14 are placed in the same place in each drum and therefore any drum unit 14 can simply be attached to the chassis 2 with e.g. bolts 39.

In FIG. 17 the standard components to be installed in all the compactors of the compactor series are: the cab 5 placed on the chassis at the front and the fuel tank 27 placed behind it. The engine 3, its protective casing 28 and the hydraulic oil tank 29 attached to it are placed at the rear end. As the efficiency of the engine 3 and of the power transmission assembly varies in ratio 1:4 in the exemplary series described in more detail later, two sizes of protective casings 28 and hydraulic oil tanks 29 are used in the compactor series. The assembly example shown in FIG. 17 corresponds to the second smallest compactor of the compactor series, and therefore the protective casing 28 of the engine and the hydralic oil tank 29 are of the smaller size.

In a way, also the dozer blade 31 attached to the front of the compactor is a standard component. The blade attached to the front drum unit through arms 32 and members such as hydraulic cylinders 33. The blade is mounted on the compactor by welding the ears 40 and 41 of the arms 32 and the hydraulic cylinders 33 to the drum frame 10 and its end pieces 6. In practice the size of the dozer blade 31 has to be varied in accordance with the width of the drum 4 so that a wide drum 4 requires a wider dozer blade 31.

FIG. 17 also shows the use of the components and the modules of the power transmission assembly at the assembly stage. The module is formed by a gear assembly 7, as many of which are mounted at the ends of the drum units as are required to transmit the power of the engine 3 to the drums 4. The gear assembly is dimensioned in such a way that when the output of the engine 3 varies in the ratio 1:4 in the various compactors of the compactor series, alternatively 1–4 gear assemblies can be used, thus producing a series of four compactors with four different capacities. The compactor in FIG. 17 has two gear assembly modules 7, of which one is attached to the front drum unit and the other to the rear drum unit. Each gear assembly 7 requires a separate hydraulic pump module 8, which is connected to the engine 3 through a power output shaft 18 and pump drive 13. The second smallest compactor shown in this figure is shown fully assembled in FIG. 25.

FIG. 18 shows a top plan view of the assembly diagram corresponding to FIG. 17. The symmetrical chassis elements 25 of the chassis 2 are connected to each other with a hinge 21 and a steering cylinder 38. The cab 5, the fuel tank 27, the engine 3 and the protective casing 28 of the engine are mounted on the chassis 2. Identical drum unit components 14 are attached to the chassis 2, and a dozer blade 31 is attached to the front drum unit. The power transmission assembly consists of two gear assembly modules 7 with their hydraulic motors 9 and two hydraulic pumps modules 8, which are connected with the engine 3 through a power output shaft 18 and a pump drive 13. In addition, although not shown in this figure, there is chain transmission from the gear assembly 7 to the sprocket at the end of the drum 4.

FIGS. 17 and 18 also show that the compactor in the figures can be formed by using two larger sets of modules located symmetrically in relation to the hinge 21. This set of modules consists of a chassis element 26, drum unit 14 with a gear assembly 7 attached to it. When two such sets of modules are connected to each other by means of a hinge 21, the main parts of the compactor are assembled. Only a dozer blade 31, cab 5 and engine 3 are then required.

FIGS. 19–22 show the assembly system of the compactor series according to the Invention diagrammatically. According to the system, a series of four compactors of different sizes is assembled by selecting the parts from drum units 14 of three different widths, from two chassis components 2 of different lengths, and from the required number of power transmission gear assembly modules 7.

The drum unit components 14 to be used have been described before in FIGS. 3–5 and they are marked with the letter A, B and C according to their widths. The chassis components 2, which have also been described before in FIGS. 6 and 7, come in two lengths, the shorter being used in the two smallest compactors in the compactor series (FIGS. 19 and 29), and and the longer being used in the two largest compactors in the compactor series (FIGS. 21 and 22) to achieve a longer wheel base.

Figure 22:
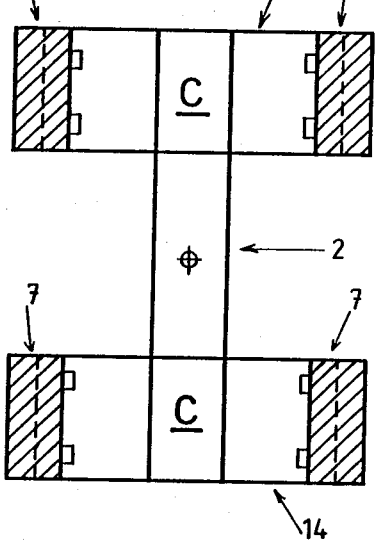
Figure 21:
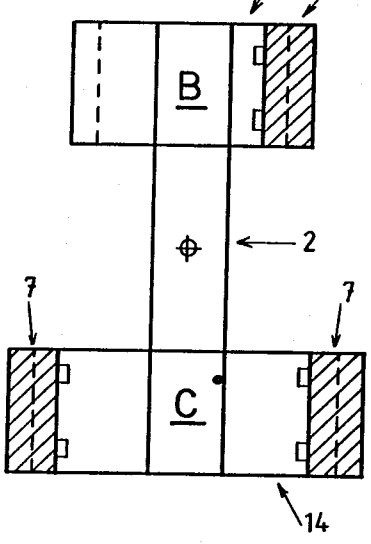
Figure 20:
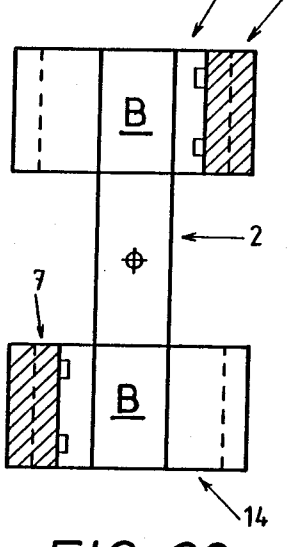
Figure 19:
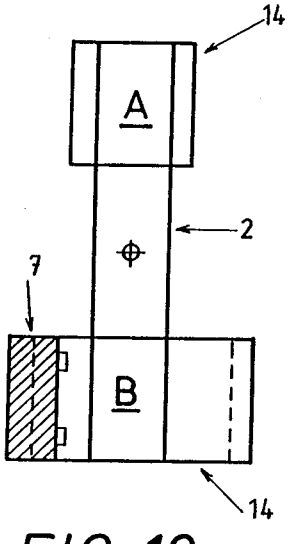

FIG. 19 shows the smallest compactor in the compactor series. It includes a narrow front drum A and medium-wide rear drum B with one power transmission gear assembly 7 attached to one end of it. FIG. 20 shows the second smallest compactor ofthe compactor series with two medium wide drums B with both have one gear assembly module 7 attached to them. FIG. 21 shows the second largest compactor of the compactor series, which has a medium-wide front drums B equipped with one gear assembly module 7, attached to the longer chassis component 2 and a wide rear drum C equipped with two gear assembly modules 7. FIG. 22 shows the largest compactor of the compactor series with two wide drums C, with two gear assembly modules 7 each, i.e. four gear assemblies altogether.

In the compactor series described in FIGS. 19–22 the widths A, B and C of the drum units 14 have been selected so as to produce, by combining drum units in the way shown by the figures, a compactor series, each compactor of which has a suitable total rolling width. According to the Invention a series of four compactors is formed, in which the total rolling widths of the drums in the compactors are related to each other principally as small integers 1, 2, 3 and 4. In other words (A+B):(B+B):(B+C):(C+C) 1:2:3:4.

In practice such an exact system cannot be reached, as mathematically the solution of the corresponding equation is A=0 and C=2B, which is not possible to reach in the above mentioned way. The rolling widths have not, however, a decisive significance. The essential point is, according to the Invention, that the relation between the weight of the compactor and the combined width of the drums remains the same. As the weights of the compactors of the compactor series are mainly dimensioned in the ratio of 1:2:3:4, too, this dimensioning can be adjusted in the same direction as the dimensioning of the drum widths. In this way the figure 4–5 tons/m as a dimensioning basis is reached with sufficient accuracy.

EXAMPLE

Practice has shown that various tasks require compactors weighing 10–40 tons. If the dimensioning basis is that 4–5 tons of the weight of the compactor falls on one meter of the drum width and that the engine power requirement is about 10 hp per ton, a series of four compactors according to the Invention is arrived at:

Drum Widths: A = 0.9 m, B = 2.3 m, C = 3.7 m

| Compactor | Drums | Combined Drum Width m | Weight of Compactor t | Weight Drum per Width t/m | Engine Output hp |
|---|---|---|---|---|---|
| I | A + B | 3.2 | 13 | 4.1 | 100 |
| II | B + B | 4.6 | 20 | 4.3 | 200 |
| III | B + C | 6.0 | 30 | 5.0 | 300 |
| IV | C + C | 7.4 | 37 | 5.0 | 400 |

The table shows that the engine outputs and the weights of the compactors are related to each other like small integers 1:2:3:4. The combined widths of the drums differ from these relations to a certain extent, but they remain within permissable limits, as the relation between the weight of the compactor and the drum width is 4–5 t/m as required by the dimensioning basis.

FIGS. 23–30 show a series of compactors of four different sizes according to the Invention, which series is formed as per the above mentioned dimensioning principles and assembly system. All the compactors have interchangeable components and modules. The drum unit widths used in the series are marked with the letters A, B, and C and the compactors are marked with figures I, II, III, and IV. FIGS. 23 and 24 show the smallest compactor of the series (I), FIGS. 25 and 26 the second smallest compactor (II), FIGS. 27 and 28 the second largest compactor (III) and FIGS. 29 and 30 the largest compactor of the series (IV).

FIGS. 23 and 24 show the smallest compactor of the exemplary series (I), whose weight is 13 tons and engine output 100 hp. When assembling the compactor of narrow drum unit A is attached to the chassis 2 at the front and a medium-wide drum unit B is attached to the chassis at the rear. The power transmission from the engine 3 to the rear drum 4 is arranged by means of a power transmission module capable of 100 hp power transmission. The power transmission module includes a gear assembly module 7 dimensioned for the transmission of 100 hp. The gear assembly module 7 rotates the drum through a chain power transmission system consisting of a sprocket and a chain and attached to one end of the drum 4. The chain power transmission module is described in more detail in FIG. 15. The power from the engine 3 is transmitted to the gear assembly module 7 by means of a hydrostatic power transmission system dimensioned for 100 hp power transmission. This system consists of a hydraulic pump module 8 rotated by the engine 3, two hydraulic motors 9 connected to the gear assembly, and the hydraulic hoses 30 between these components. For the sake of simplicity only one hose connecting the pump and the motor is drawn in all the figures, but naturally a hydraulic system consists of a pressure hose and a return hose. As the compactor I described in FIGS. 23 and 24 only has one power transmission module, it has been possible to connect its only hydraulic pump direct to the power output shaft of the engine 3.

FIGS. 25 and 26 show the second smallest compactor (II) of the exemplary series. Its weighs 20 tons and its engine output is 200 hp. The assembly diagram of this compactor is shown in FIGS. 17 and 18. The compactor consists of two identical medium-wide drum units B with an identical gear assembly module 7 attached to both ends. As also the short chassis element 25 at the front and at the rear of the chassis 2 are identical, it can be said that the compactor mainly consists of two identical sets of components consisting of a chassis element 25, drum unit 14 and gear assembly 7. In addition, the power transmission assembly includes hydraulic motors 9 and a hydraulic pump module 8 connected to each gear assembly 7 separately. Both the hydraulic pumps 8 are connected to the power output shaft of the engine 3 through a pump drive 13.

FIGS. 27 and 28 show the second largest compactor (III) of the series. It weighs 30 tons and its engine output is 300 hp. The front drum unit 14 of the compactor is medium-wide (B) and equipped with one gear assembly module 7. The rear drum unit is is wide (C) equipped with two gear assembly modules 7. Consequently a corresponding number of hydraulic pump modules 8 are required, i.e. 3, which are connected to the power output shaft of the engine 3 through a pump drive 13 and a connecting piece 17.

FIGS. 29 and 30 show the largest compactor (IV) of the exemplary series. It weighs 37 tons and the engine output is 400 hp. Both drums of the compactor are wide (C) with a gear assembly module 7 at each end. As the chassis elements 26 forming the front and the rear parts of the chassis are also identical, this compactor, too, is formed of two identical sets of components consisting of a chassis element 26, a drum unit 14 and two sets of gear assemblies 7. The second smallest compactor shown in FIGS. 25 and 26 of the series (II) was assembled in the similar way symmetrically. Each gear assembly module 7 requires a hydraulic pump module 8, i.e. four altogether connected to the power output shaft of the engine 3 through a pump drive 13 and a connecting piece 17.

In the assemblies described above the compactors are assembled from three drum units of different sizes A, B and C, as well as of interchangeable components and modules. Those modules of which a varying number is incorporated in the compactor include gear assemblies 7 with their hydraulic motors 9 and hydraulic pumps 8. In addition, it was noted that in two compactors (II and IV) the chassis elements (25 or 26) located on the opposite sides of the hinge 21, together with the drum units and gear assemblies connected to them, are identical, and therefore form a set of modules to be used in assembling the compactor. Further, it can be noted that the gear assemblies 7 are attached to the roller units 14 in the following three different ways only:

drum unit A, no gear assembly
drum unit B, one gear assembly at one end
drum unit C, two gear assemblies Therefore the drum units 14 can be pre-equipped with the gear assemblies 7 for the assembly of the compactor. Sets formed in this way can also be regarded as modules that can be used in assembling the compactor, the number of these sets (0, 1 or 2) depending on the size of the compactor.

FIGS. 31–33 show a compactor (II) in accordance with the Invention packed in a transport container. The figure shows how efficient the component and module system is in transportation, as well. By dimensioning the component as per the principles described above, the compactor (II) can be fitted into a 6 m container. The smallest compactor (I) also fits into this container, as the only difference is one narrower drum unit 14. The largest compactors of the series III and IV fit into a container the length of which is slightly more.

It is apparent to one skilled in the art that the various embodiments of the Invention can vary within the patent claims presented below.

What is claimed is:

1. A method of providing a series of diverse sizes of compacting vehicles for use in compacting earth, tailings, and the like, each such vehicle consisting essentially of four types of sub-assemblies, namely a chassis, an engine, cylinder shaped drums, and a power transmission sub-assembly for transmitting rotary motion of the engine to one or more of the drums, wherein the size of each vehicle is the total weight of the sub-assemblies constituting the vehicle, each sub-assembly adapted for modular mounting to one or more sub-assemblies of a different type so as to form a said vehicle of the series, wherein the method includes the steps of providing at least two sizes of each of said drum and engine sub-assemblies, and providing, for each compactor vehicle of the series, the following sub-assemblies:

an engine of a size substantially directly proportional to the size of the vehicle, drums, the width dimension of each said drum being selected to that the combined widths of the drums of the vehicle are substantially directly proportional to the size of the vehicle; and a power transmission sub-assembly comprising one or more substantially identical power transmission units, wherein the number of such units is in direct proportion to the size of the said compactor, wherein the proportion of vehicle size to the size, combined drum widths or number, of its engine, drums or power transmission sub-assemblies, respectively, is a constant which is substantially the same for all different vehicles of the series, and wherein the largest vehicle of the series weighs at least about 1.5 times the weight of the smallest vehicle of the series.

2. The method of claim 1, wherein a transmission unit includes a gear assembly module for driving a drum, such gear assembly module having means for mounting the module on a drum frame and including an output drive member for mating with a corresponding drive member on the drum for driving said drum, and further includes at least one hydraulic motor for receiving hydraulic fluid power from the engine and driving said output drive member, wherein the method includes the step of mounting between one and four identical said gear assembly modules at ends of the drums of the vehicle, said number of gear assembly modules being selected in direct proportion to the size of the compactor.

3. The method of claim 2, further including the step of providing, for each gear assembly module of a said vehicle, a separate hydraulic pump module driven by the engine for converting motion of the engine to fluid power for driving each said respective gear assembly module, and further including the step of providing a pump drive means for interconnecting the engine with each said separate hydraulic pump module.

4. The method of claim 3, wherein a drum sub-assembly includes a drum frame, a drum of width corresponding to the width of the frame, provided in different widths as required, and an end piece, the number of drum units of different sizes being no greater than the number of different size compactor vehicles of the series.

5. The method of claim 4, including the step of providing three different widths of drums, namely narrow (A), medium-wide (B) and wide (C) and wherein the series includes four compactors of different sizes assembled using two drums each of the said three drum component types of different sizes, selected according to the following table

| Compactor | Front Drum | | Rear Drum | |
|---|---|---|---|---|
| I | Narrow | (A) | Medium-Wide | (B) |
| II | Medium-Wide | (B) | Medium-Wide | (B) |
| III | Medium-Wide | (B) | Wide | (C) |
| IV | Wide | (C) | Wide | (C) |

6. A compactor vehicle for compacting refuse and other compacting tasks, the essential parts of the compactor being chassis, engine, cylinder-shaped drums, and a power transmission assembly for transmitting rotary motion of the engine to one or more drums, wherein the said essential parts of the compactor are provided in a plurality of different sizes or plural parts each adapted for assembly together with other said essential components so as to form compactors of different sizes, the size of a said vehicle being the total weight of the essential parts forming the vehicle, and wherein a said compactor is assembled of said essential components selected such that:

the size of the engine of the compactor vehicle is substantially directly proportional to the size of the vehicle;

the combined width dimensions of the drums of the vehicle are substantially directly proportional to the size of the vehicle; and the power transmission assembly comprises a plurality of identical power transmission units, the number of such units being selected in direct proportion to the size of the vehicle, wherein the range of different sizes of said essential parts is such that at least one further vehicle of a different size may be assembled by selecting at least some different essential parts while maintaining substantially identical proportions of vehicle size to the engine size, combined width dimensions of the drums, and number of power transmission units, respectively, of said at least one further vehicle; and wherein the range of different sizes of said essential parts is such that two vehicles of different sizes may be assembled therefrom having total weights in the ratio of at least about 1.5:1.

7. A compactor according to claim 6 including hydraulic pump means connected to the engine for converting rotary motion of the engine to fluid power, and wherein a said power transmission unit includes a hydraulic motor, in fluid communication with the pump means an driven thereby, and wherein the transmission unit further includes a gear assembly attached to a drive sprocket for driving the drum, said gear assembly being driven by the hydraulic motor, and wherein the compactor vehicle includes one said hydraulic pump for each said gear assembly module.

8. A compactor according to claim 7, wherein the alternative systems of power transmission between the engine and the drums include from one to four substantially identical gear assembly modules driven substantially as follows:

(i) for one gear assembly module, one hydraulic pump driven by an engine drives one gear assembly module mounted on the drum frame, which gear assembly modules drives one drum at an end thereof;

(ii) two gear assembly modules each is driven by a separate hydraulic pump module driven by the engine, wherein one said gear assembly drives a first drum and the other drives a second drum;

(iii) for three gear assembly modules each is driven by a separate hydraulic pump module driven by the engine, wherein one said gear assembly module drives a first drum at one end, and the remaining two gear assembly modules each drive a second drum at respective opposing ends thereof;

(iv) for four gear assembly modules each is separately driven by a hydraulic pump module driven by the engine, wherein two gear assemblies drive a first drum, one at each end, and the other two drive a second drum, one at each end, whereby each drum is driven at both ends.

9. A compactor according to claim 8, wherein the engine output power is substantially proportional to the number of transmission units.

10. A compactor according to claim 8, further including a pump drive means for driveably connecting a plurality of hydraulic pumps to the engine such that two hydraulic pump modules may connect to the pump drive on one side thereof, and wherein the drive means is adapted to mount with a jack shaft intermediate the engine and the drive means, so that three or four hydraulic pump modules may connect to the drive means, by connecting one or two such pump modules to the drive on the engine side between the engine and the pump drive, and the remaining one or two hydraulic pumps on the opposite side of the drive in such a way that two hydraulic pumps are located facing each other on the opposite sides of the pump drive and connected to opposite ends of a common power output shaft of the pump drive means.

11. A compactor according to claim 10, wherein each said drum sub-assembly includes a drum and a drum frame having end pieces, each said end piece including a freely turning bearing, said drum frames being adapted for interchangeably mounting with other compactors of the series, and said end pieces being adapted for interchangeably mounting with drum units of different widths, wherein a said frame is adapted to secure thereon a gear assembly and drive sprocket in a position to drive a mating sprocket mounted on a drum.

12. A compactor according to claim 11, wherein a drum unit includes a drum, a drum frame and end pieces, all dimensioned in such a way that the radii of all the drums are substantially identical, and wherein said compactor includes two drum units selected from one of the combinations of three interchangeable drum units of the three different widths narrow (A), medium-wide (B) and wide (C), in accordance with the following table:

| Compactor | Front Drum | | Rear Drum | |
|---|---|---|---|---|
| I | Narrow | (A) | Medium-Wide | (B) |
| II | Medium-Wide | (B) | Medium-Wide | (B) |
| III | Medium-Wide | (B) | Wide | (C) |
| IV | Wide | (C) | Wide | (C) |

13. A compactor according to claim 12, wherein the drum units of the compactor are dimensioned in such a way that the ratio between the weight of the compactor and the combined width of both the drums is approximately 4–5 tons/m.

14. A compactor series comprising compactors of different sizes, wherein each compactor includes at least one gear assembly and a pair of drum units, a chassis and an engine, and wherein the weight of each compactor is essentially the total weight of its gear assemblies, pair of drum units, chassis and engine, characterized in that by varying the number of the gear assemblies between 1 and 4, and by combining two drums selected from drums of the three drum widths denoted A, B, and C for narrow, medium and wide widths, respectively, a series of four compactors (I, II, III and IV) is formed, and each compactor of the series simultaneously satisfies the constraints that the weight of a compactor, the combined widths of both its drums, and its power outputs are substantially multiples of a small integer times the weight of a smallest compactor of the series, or its combined width or power output, respectively, and wherein the relationship of drum widths and gear assemblies of the series is as follows:

| Compactor | Total Number of Gear Assemblies | Front Drum Unit Width | Front Drum Unit Number of Gear Assemblies | Rear Drum Unit Width | Rear Drum Unit Number of Gear Assemblies |
|---|---|---|---|---|---|
| I | 1 | A | 0 | B | 1 |
| II | 2 | B | 1 | B | 1 |
| III | 3 | B | 1 | C | 2 |
| IV | 4 | C | 2 | C | 2 |

15. A compactor series according to claim 14, wherein the widths of the drum units in the compactor series are approximately A=0.9 m, B=2.3 m and C=3.7 m, and wherein the following compactor series is formed by means of the drum units:

| Compactor | Drums | Total Drum Width m | Weight t | Weight Drum Width t/m | Engine Output hp |
|---|---|---|---|---|---|
| I | A + B | 3.2 | 13 | 4.1 | 100 |
| II | B + B | 4.6 | 20 | 4.3 | 200 |
| III | B + C | 6.0 | 30 | 5.0 | 300 |
| IV | C + C | 7.4 | 37 | 5.0 | 400 |

16. A compactor series according to claim 15, wherein each compactor includes a chassis comprising two chassis components centrally hinged together, each said chassis component having an attaching portion at an end thereof for interchangeably mounting to wa said drum unit, wherein the series includes a longer and a shorter chassis component which are otherwise substantially identical, and wherein the shorter chassis component is used in the two smallest compactors of the series and the longer chassis component is used in the two largest compactors of the series, whereby a longer wheelbase is reached in the compactors using a wide drum, than in the compactors using a less wide drums.

* * * * *